US005850701A

United States Patent [19]

Graf

[11] Patent Number: 5,850,701

[45] Date of Patent: Dec. 22, 1998

[54] DRYER GROUP WITH CONTROLLED HEATING AND COOLING OF A PAPER WEB IN A PAPER-MAKING MACHINE

[75] Inventor: Edwin X. Graf, Menasha, Wis.

[73] Assignee: Voith Sulzer Paper Technology North America, Inc., Appleton, Wis.

[21] Appl. No.: 869,791

[22] Filed: Jun. 5, 1997

[51] Int. Cl.[6] ..... D21F 5/00

[52] U.S. Cl. ..... 34/117; 34/119

[58] Field of Search ..... 34/111, 116, 117, 34/119, 120, 123, 124

[56] References Cited

U.S. PATENT DOCUMENTS

| | | | |
|---|---|---|---|
| 4,622,758 | 11/1986 | Lehtinen et al. | 34/116 X |
| 4,625,430 | 12/1986 | Aula et al. | 34/116 X |
| 5,033,207 | 7/1991 | Sturn et al. | 34/115 |

*Primary Examiner*—Henry A. Bennett
*Assistant Examiner*—Steve Gravini
*Attorney, Agent, or Firm*—Taylor & Associates, P.C.

[57] ABSTRACT

A dryer group for drying a paper web moving in a running direction through a paper-making machine includes and upper tier and a lower tier. The upper tier and lower tier each include a plurality of rotatable cylinders for carrying the paper web. Each of the cylinders has an inner chamber. The plurality of cylinders for the upper tier and the lower tier each include at least two drying cylinders and at least one cooling cylinder. The at least one cooling cylinder is disposed downstream from the at least two drying cylinders, relative to the running direction of the paper web. The upper tier and lower tier also each include a plurality of carrier rolls, with each carrier roll being disposed adjacent to a pair of corresponding cylinders. An upper felt and lower felt are alternately carried by each of the cylinders and each of the carrier rolls of the upper and lower tiers, respectively. A steam generating device is fluidly connected with the inner chamber of each drying cylinder of the upper and lower tiers, and a cooling fluid generating device is fluidly connected with the inner chamber of each cooling cylinder of the upper and lower tiers.

16 Claims, 1 Drawing Sheet

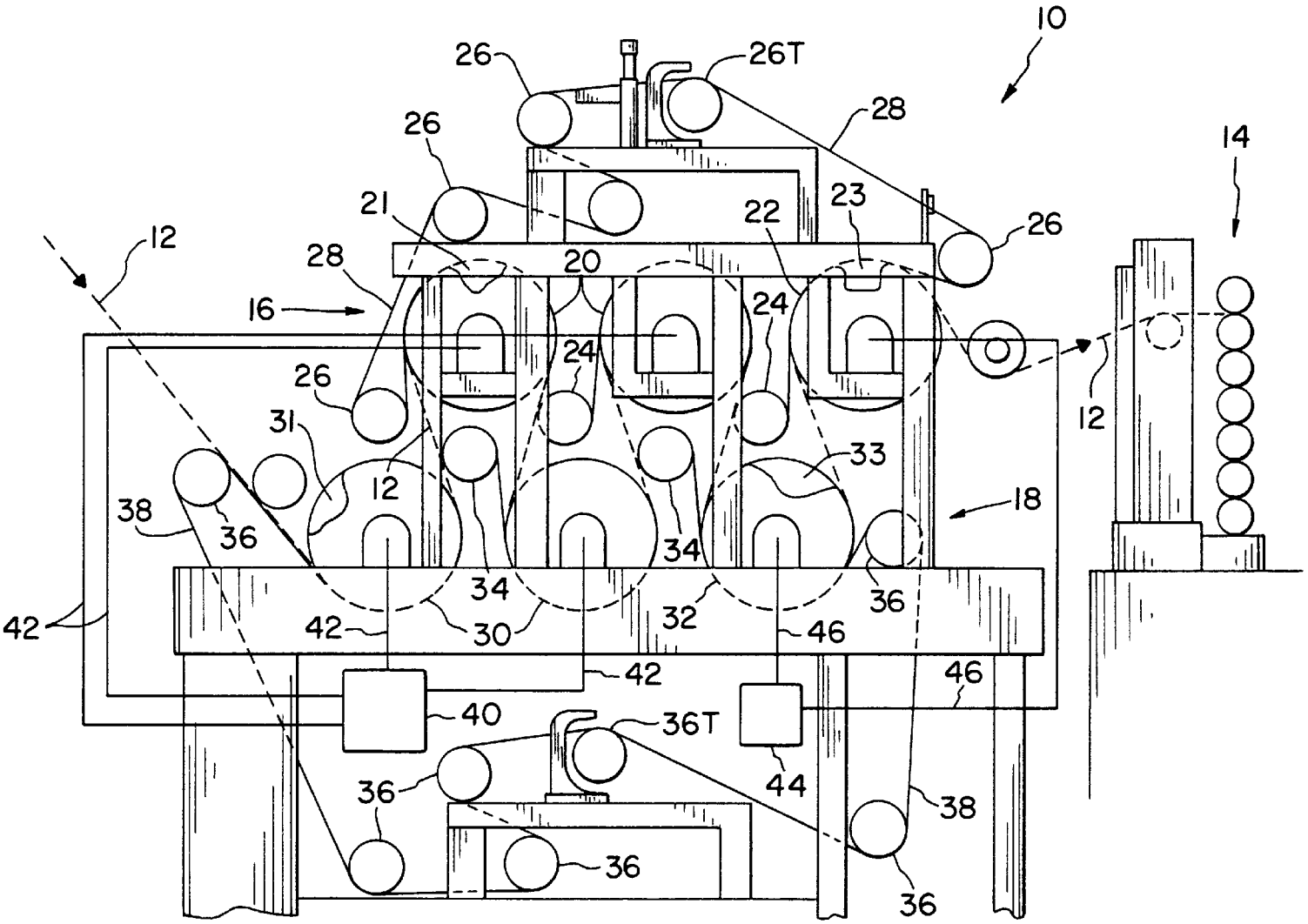
10
14
12
18
26
28
26T
23
22
24
33
36
46
38
44
32
34
36T
42
20
30
40
21
16
31

DRYER GROUP WITH CONTROLLED HEATING AND COOLING OF A PAPER WEB IN A PAPER-MAKING MACHINE

BACKGROUND OF THE INVENTION

1. Field of the Invention

The present invention relates to a paper-making machine, and, more particularly, to a two tier dryer group for drying a paper web in a paper-making machine.

2. Description of the Related Art

A paper-making machine may be thought of as including various portions or sections along the running direction of the paper web through the machine. For example, the paper-making machine may include a wet end, a forming section, a press section and a dryer section. The dryer section receives a higher moisture content paper web and drys the paper web to a desired lower moisture content. The dryer section includes a plurality of heated drying cylinders which respectively engage and carry the paper web from the upstream end of the dryer section to the downstream end of the dryer section.

It is known to provide a dryer section with a plurality of single tier, top felted dryer groups which are arranged in series along the running direction of the paper web. Each single tier, top felted dryer group includes a plurality of drying cylinders which are arranged in substantially horizontal alignment with each other. The paper web is carried by the drying cylinders such that the cylinders of each dryer group contact only one side of the paper web. Drying the paper web from only one side thereof may result in a defect within the paper web known as "latent curl". Since the heat is applied to only one side of the paper web, the moisture content of the paper web on one side thereof may be less than the moisture content on the opposing side thereof. The difference in moisture content from one side to the other of the paper web may cause the fibers on one side of the paper web to contract more than the other side, thereby causing the latent curl within the paper web.

A two tier dryer group may be disposed at the downstream side of the single tier dryer groups. The two tier dryer group includes an upper tier and a lower tier with respective upper and lower felts. The upper tier and lower tier each include a plurality of drying cylinders which are connected to a source of steam. The paper web is carried in alternating fashion from a drying cylinder of the upper tier to a drying cylinder of the lower tier, and vice versa through the two tier dryer group. The pressure and/or temperature of the steam within each drying cylinder may be commonly or independently adjusted to control the heat transfer rate to the paper web carried by the drying cylinders.

A two tier dryer group as described above is effective to a limited extent to control latent curl which may develop in the paper web as a result of each individual drying cylinder group in the single tier dryer groups contacting only one side of the paper web. However, since heat is transferred from all of the drying cylinders to the paper web, although at varying degrees, the amount to which the latent curl can be controlled is limited.

It is known to control the pressure and/or temperature between adjacent drying cylinders such that the amount of heat transferred into the paper web varies from one drying cylinder to the next. For example, the pressure within one drying cylinder may be increased such that a portion of the steam within the drying cylinder is condensed to a liquid. However, the major portion of the fluid within the drying cylinder remains in steam form which is of course very hot and above the vaporization temperature of the water within the paper web carried by the drying cylinder. Thus, increasing the operating pressure within the drying cylinder to increase the amount of condensate within the drying cylinder merely acts to slow the rate at which heat is transferred into the paper web. The paper web is not cooled, but rather is merely heated at a slower heat transfer rate.

Another problem with a two tier dryer group as described above is that the moisture content of the paper web is always reduced as the paper web travels through the two tier dryer group. That is, the heat added to the paper web by each heated drying cylinder further drys and removes moisture from the paper web. However, it may be desirable to add moisture back into the paper web within the dryer group. For example, dependent upon water retention properties within the paper web, etc., the actual moisture content could decrease below a desired level. Moreover, it may be desirable to add moisture back into the paper web for the purpose of assisting and controlling the latent curl therein.

It is known to provide additional structure within a dryer group for the purpose of adding moisture back into the paper web.

For example, it is known to provide water jets or nozzles which are positioned across the width of the paper web within a dryer group and spray a mist of water onto the paper web traveling thereby. Such jets or nozzles, and the supply system associated therewith, add to the cost and complexity of the dryer group. Moreover, size and space limitations of the dryer group may not allow the use of such jets or nozzles.

It is also known to utilize devices for blowing heating or cooling air onto the paper web and/or drying cylinders within a dryer group. Heating or cooling air which is directed onto a drying cylinder may change the heat transfer rate into the paper web. However, the paper web is still heated; only the rate of heat transfer is changed. Heating or cooling air which is blown onto the paper web is effective to change the temperature of the paper web. However, the heating or cooling air which is blown onto the paper web also acts to further reduce the moisture content of the paper web, which may be undesirable. Additionally, as described above with reference to the known water jets or nozzles, physical size and space limitations of the dryer group may not allow the use of such air blowing devices.

What is needed in the art is a dryer group which more effectively allows both the latent curl and the moisture content within a paper web to be controlled within a dryer group.

SUMMARY OF THE INVENTION

The present invention provides a two-tier dryer group having an upper tier of cylinders and a lower tier of cylinders. The upper tier and lower tier each include at least one cooling cylinder disposed at the downstream side of the dryer group for cooling and/or adding moisture to the paper web.

The invention comprises, in one form thereof, a dryer group for drying a paper web moving in a running direction through a paper-making machine. An upper tier includes a plurality of rotatable upper cylinders for carrying the paper web. Each of the upper cylinders has an inner chamber. The plurality of upper cylinders include at least two drying cylinders and at least one cooling cylinder. The at least one cooling cylinder is disposed downstream from the at least two drying cylinders, relative to the running direction of the paper web. A plurality of upper carrier rolls are each disposed adjacent to a pair of the upper cylinders. An upper felt is alternately carried by each of the upper cylinders and each of the upper carrier rolls. A lower tier includes a plurality of rotatable lower cylinders for carrying the paper web. Each of the lower cylinders has an inner chamber. The plurality of lower cylinders include at least two drying cylinders and at least one cooling cylinder. The at least one cooling cylinder is disposed downstream from the at least two drying cylinders, relative to the running direction of the paper web. A plurality of lower carrier rolls are each disposed adjacent to a pair of the lower cylinders. A lower felt is alternately carried by each of the lower cylinders and each of the lower carrier rolls. A steam generating device is fluidly connected with the inner chamber of each drying cylinder of the upper and lower tiers, and a cooling fluid generating device is fluidly connected with the inner chamber of each cooling cylinder of the upper and lower tiers.

An advantage of the present invention is that an improved control of latent curl in the paper web is provided.

Another advantage is that the moisture content of the paper web can be controlled without the use of additional structure within the dryer group such as water jets, etc.

Yet another advantage is that the paper web may be cooled prior to exiting the dryer group.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawing, which is a schematic, side view of one embodiment of a two-tier dryer group of the present invention.

The exemplification set out herein illustrates one preferred embodiment of the invention, in one form, and such exemplification is not to be construed as limiting the scope of the invention in any manner.

DETAILED DESCRIPTION OF THE INVENTION

Referring now to the drawing, there is shown a schematic, side view of one embodiment of a two tier dryer group 10 of the present invention. Dryer group 10 receives a paper web 12, such as from a single tier dryer group (not shown), and outputs the paper web 12 to a calender stack 14.

Dryer group 10 generally includes an upper tier 16 and a lower tier 18. Upper tier 16 includes a plurality of rotatable upper cylinders 20 and 22, a plurality of upper carrier rolls 24, a plurality of guide rolls 26 and an upper felt 28. Rotatable upper cylinders 20 and 22 carry paper web 12. Rotatable upper cylinders 20 are in the form of drying cylinders having an inner chamber 21 and an outer surface. A hot fluid, such as steam, is transported through each drying cylinder 20 to thereby heat the outer surface thereof. Paper web 12 contacts a substantial portion of the outer surface of each drying cylinder 20 and is heated thereby to dry paper web 12.

Upper cylinder 22 is in the form of a cooling cylinder having an inner chamber 23 and an outer surface. A cooling fluid, such as cooling water, is transported through cooling cylinder 22 to thereby cool the outer surface thereof. Paper web 12 contacts a substantial portion of the outer surface of cooling cylinder 22 and is cooled thereby. Cooling cylinder 22 is disposed downstream from the two drying cylinders 20, relative to the running direction of paper web 12 through dryer group 10.

Upper carrier rolls 24 are disposed adjacent to and between a corresponding pair of upper cylinders 20, 22. Upper carrier rolls 24 carry upper felt 28 and direct upper felt 28 from one upper cylinder 20, 22 to an adjacent and downstream upper cylinder 20, 22. By placing upper carrier rolls 24 between and substantially below upper cylinders 20 and 22, upper felt 28 is maintained in contact with a longer length of paper web 12 around each upper cylinder 20, 22.

Guide rolls 26 carry upper felt 28 from a downstream end to an upstream end of upper tier 16. Upper felt 28 is configured as an endless felt, and thus continuously travels around upper cylinders 20 and 22, upper carrier rolls 24 and guide rolls 26. At least one of guide rolls 26 is configured as a tensioning roll 26T for applying a desired longitudinal tension to upper felt 28.

Lower tier 18 includes a plurality of rotatable lower cylinders 30 and 32, a plurality of lower carrier rolls 34, a plurality of guide rolls 36 and a lower felt 38. Rotatable lower cylinders 30 and 32 carry paper web 12. Rotatable lower cylinders 30 are in the form of drying cylinders having an inner chamber 31 and an outer surface. A hot fluid, such as steam, is transported through each drying cylinder 30 to thereby heat the outer surface thereof. Paper web 12 contacts a substantial portion of the outer surface of each drying cylinder 30 and is heated thereby to dry paper web 12.

Lower cylinder 32 is in the form of a cooling cylinder having an inner chamber 33 and an outer surface. A cooling fluid, such as cooling water, is transported through cooling cylinder 32 to thereby cool the outer surface thereof. Paper web 12 contacts a substantial portion of the outer surface of cooling cylinder 32 and is cooled thereby. Cooling cylinder 32 is disposed downstream from the two drying cylinders 30, relative to the running direction of paper web 12 through dryer group 10.

Lower carrier rolls 34 are disposed adjacent to and between a corresponding pair of lower cylinders 30, 32. Lower carrier rolls 34 carry lower felt 38 and direct lower felt 38 from one lower cylinder 30, 32 to an adjacent and downstream lower cylinder 30, 32. By placing lower carrier rolls 34 between and substantially above lower cylinders 30 and 32, lower felt 38 is maintained in contact with a longer length of paper web 12 around each lower cylinder 30, 32.

Guide rolls 36 carry lower felt 38 from a downstream end to an upstream end of lower tier 18. Lower felt 38 is configured as an endless felt, and thus continuously travels around lower cylinders 30 and 32, lower carrier rolls 34 and guide rolls 36. At least one of guide rolls 36 is configured as a tensioning roll 36T for applying a desired longitudinal tension to lower felt 38.

A steam generating device 40, shown schematically in the drawing, is fluidly connected via fluid lines 42 with each of the drying cylinders 20 and 30 of the upper tier 16 and lower tier 18, respectively. The temperature and/or pressure of the steam which is supplied through fluid lines 42 to drying cylinders 20 and 30 may be commonly or independently controlled. If the steam supply through fluid lines 42 is commonly controlled by steam generating device 40, then the operating temperature at the outer surface of each of drying cylinders 20 and 30 is approximately the same. On the other hand, if the temperature and/or pressure of the steam supply through fluid lines 42 is independently controlled from one fluid line 42 to another, then the operating temperature of the outer surface of each drying cylinder 20 and 30 may be separately varied. For example, the temperature may be increased and the pressure decreased within a drying cylinder 20 or 30 to produce super-heated steam which is transported through the inner chamber 21, 31 thereof. The super-heated steam may increase the operating temperature of the outer surface of an associated drying cylinder 20 or 30 to increase the drying capacity of a particular drying cylinder. Contrarily, the temperature of the steam may be decreased and the pressure within the inner chamber 21, 31 increased to produce a certain amount of condensate within the inner chamber of the drying cylinder. The operating temperature at the outer surface of the associated drying cylinder is thus decreased, thereby decreasing the heat transfer rate to the paper web and the drying capacity of the drying cylinder. Thus, by changing the temperature and/or pressure of the steam which is transported through drying cylinders 20 and 30, the drying capacity of each separate drying cylinder may be controlled. Varying the drying capacity of the drying cylinders 20 and 30 may assist in controlling latent curl within paper web 12.

According to the present invention, a cooling fluid generating device 44 is fluidly connected via fluid lines 46 with cooling cylinders 22 and 32 of upper tier 16 and lower tier 18, respectively. Cooling fluid generating device 44 transports a cooling fluid, such as cooling water, through an inner chamber 23, 33 of each cooling cylinder 22 and 32, respectively. In the embodiment shown, each cooling cylinder 22 and 32 is substantially hollow, and the inner chamber 23, 33 occupies the majority of the interior of each cooling cylinder 22 and 32. However, the inner chamber 23, 33 may also be in the form of one or more sleeves or conduits within cooling cylinders 22 and 32 through which the cooling fluid is transported. The cooling fluid may occupy a portion or substantially all of the inner chamber 23, 33 within each cooling cylinder 22 and 32.

The temperature of the cooling fluid is controlled using cooling fluid generating device 44 such that the paper web is cooled thereby. Since the paper web primarily includes fibers and water, the temperature of the cooling fluid should in a broad sense be maintained below the combustion temperature of dry paper at ambient pressure, i.e., about 451° F. Thus, if the drying cylinders 20, 30 are operated at a temperature of about 450° F., the cooling cylinders 22, 32 could operate at a temperature of, e.g., 400° F. and cooling would still occur. Preferably, the cooling fluid is maintained at a temperature below the vaporization temperature of water (i.e., 212° F.) such that a more efficient cooling of the paper web 12 occurs. If the cooling fluid is in the form of cooling water, the operating temperature of the cooling fluid may vary between 1° F. and 400° F., preferably vary between 1° F. and 371° F. (at 160 psi), more preferably vary between 1° F. and 300° F., and even more preferably vary between 1° F. and 211° F. However, if the cooling fluid is other than water, the operating temperature of the cooling fluid may actually be lower than 1° F. as long as the cooling fluid remains in a fluid state. Of course, a cooling fluid other than water may be provided in either a gas or liquid form with an operating temperature which is below that of the paper web 12 and above that of the temperature of solidification of the cooling fluid.

Transporting a cooling fluid through cooling cylinders 22 and 32 also makes it possible to increase the moisture content of paper web 12 without adding any additional structure to dryer group 10. More particularly, the operating temperature of the cooling fluid transported through at least one of the cooling cylinders 22 and/or 32 may be controlled such that the outer surface of the associated cooling cylinder sweats, resulting in the formation of small water droplets at the outer surface of the cooling cylinder. As paper web 12 is carried by the cooling cylinder 22, 32, the water at the outer surface thereof is absorbed into paper web 12, thereby increasing the moisture content of paper web 12. Increasing the moisture content of paper web 12 may be desirable for controlling latent curl in paper web 12 and/or increasing the moisture content of paper web 12 to a desired level. Cooling cylinders 22 and 32 therefore provide the dual functionality of assisting in controlling latent curl in paper web 12 as well as controlling the moisture content in paper web 12.

The supply of cooling fluid to each cooling cylinder 22 and 32 may be separately controlled through fluid lines 46 using cooling fluid generating device 44. The supply of cooling fluid through each fluid line 46 may be commonly controlled or independently controlled using cooling fluid generating device 44. If the temperature and/or pressure of the cooling fluid within each fluid line 46 is commonly controlled using cooling fluid generating device 44, the operating temperature at the outer surface of each cooling cylinder 22 and 32 is approximately the same. On the other hand, if the supply of cooling fluid through fluid lines 46 is independently controlled using cooling fluid generating device 44, the operating temperature at the outer surface of each cooling cylinder 22 and 32 may independently vary relative to each other. Independently controlling the operating temperature of the outer surface of each cooling roll 22 and 32 in turn allows the cooling from one side of paper web 12 and/or the amount of moisture added to one side of paper web 12 to be independently controlled.

In the embodiment shown, a flow of cooling fluid in the form of cooling water is transported through cooling cylinders 22, 32. If the flow of cooling water is maintained at a positive flow rate, the outer surface of each cooling cylinder 22, 32 reaches a steady state operating temperature dependent upon the temperature of the cooling water and the temperature of paper web 12. When no cooling water is transported through cooling cylinders 22, 32 (i.e., a flow rate of zero), the outer surface of each cooling cylinder 22, 32 reaches a steady state operating condition associated with the operating temperature of paper web 12. However, since cooling cylinders 22, 32 are large masses, they basically act as heat sinks and some cooling still occurs. It is also possible to transport a flow of steam through cooling cylinders 22, 32 such that cooling still takes place. For example, the temperature and pressure of the steam transported through each cooling cylinder 22, 32 may be such that the operating temperature at the outer surface thereof is less than the paper web carried thereby. Accordingly, latent curl within paper web 12 may still be controlled by transporting steam through cooling cylinders 22, 32 which is at a lower temperature than the operating temperature of paper web 12.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A dryer group for drying a paper web moving in a running direction through a paper-making machine, said dryer group comprising:

an upper tier including a plurality of rotatable upper cylinders, each of said upper cylinders for carrying and directly contacting the paper web, each of said upper cylinders having an inner chamber and a first circumference, said plurality of upper cylinders including at least two drying cylinders and at least one cooling cylinder, each said cooling cylinder disposed downstream from each said drying cylinder, relative to the running direction of the paper web;

a plurality of non-thermally compensated upper carrier rolls, each said upper carrier roll disposed adjacent to a pair of said upper cylinders and having a second circumference substantially smaller than each said first circumference of said upper cylinders;

an upper felt alternately carried by each of said upper cylinders and each of said upper carrier rolls;

a lower tier including a plurality of rotatable lower cylinders, each of said lower cylinders for carrying and directly contacting the paper web, each of said lower cylinders having an inner chamber and a third circumference, said plurality of lower cylinders including at least two drying cylinders and at least one cooling cylinder, each said cooling cylinder disposed downstream from each said drying cylinder, relative to the running direction of the paper web;

a plurality of non-thermally compensated lower carrier rolls, each said lower carrier roll disposed adjacent to a pair of said lower cylinders and having a fourth circumference substantially smaller than each said third circumference of said lower cylinders;

a lower felt alternately carried by each of said lower cylinders and each of said lower carrier rolls;

a steam generating device fluidly connected with said inner chamber of each said drying cylinder of said upper tier and said lower tier; and a cooling fluid generating device fluidly connected with said inner chamber of each said cooling cylinder of said upper tier and said lower tier.

2. A dryer group for drying a paper web moving in a running direction through a paper-making machine, said dryer group comprising:

an upper tier including a plurality of rotatable upper cylinders for carrying the paper web, each of said upper cylinders having an inner chamber, said plurality of upper cylinders including at least two drying cylinders and at least one cooling cylinder, said at least one cooling cylinder disposed downstream from said at least two drying cylinders, relative to the running direction of the paper web;

a plurality of upper carrier rolls, each said upper carrier roll disposed adjacent to a pair of said upper cylinders;

an upper felt alternately carried by each of said upper cylinders and each of said upper carrier rolls;

a lower tier including a plurality of rotatable lower cylinders for carrying the paper web, each of said lower cylinders having an inner chamber, said plurality of lower cylinders including at least two drying cylinders and at least one cooling cylinder, said at least one cooling cylinder disposed downstream from said at least two drying cylinders, relative to the running direction of the paper web;

a plurality of lower carrier rolls, each said lower carrier roll disposed adjacent to a pair of said lower cylinders;

a lower felt alternately carried by each of said lower cylinders and each of said lower carrier rolls;

a steam generating device fluidly connected with said inner chamber of each said drying cylinder of said upper tier and said lower tier; and a cooling fluid generating device fluidly connected with said inner chamber of each said cooling cylinder of said upper tier and said lower tier, said cooling fluid generating device defining a means for providing independent flows of cooling fluid to each said cooling cylinder of said upper tier and said lower tier.

3. The dryer group of claim 1, wherein each said cooling cylinder of said upper tier and said lower tier includes an outer surface, and wherein said cooling fluid generating device defines a means for generating water condensation on said outer surface of at least one of said cooling cylinders.

4. The dryer group of claim 1, wherein said cooling fluid generating device is configured to provide cooling water to each said cooling cylinder of said upper tier and said lower tier at any temperature between approximately 1° F. and 400° F.

5. The dryer group of claim 4, wherein said cooling fluid comprises cooling water which is provided to each said cooling cylinder at any temperature between approximately 1° F. and 300° F.

6. The dryer group of claim 5, wherein said cooling fluid comprises cooling water which is provided to each said cooling cylinder at any temperature between approximately 1° F. and 211° F.

7. The dryer group of claim 1, wherein said cooling fluid comprises a liquid.

8. The dryer group of claim 1, wherein said cooling fluid comprises water.

9. A dryer group for drying a paper web moving in a running direction through a paper-making machine, said dryer group comprising:

an upper tier including a plurality of rotatable upper cylinders for carrying the paper web, each of said upper cylinders having an inner chamber, said plurality of upper cylinders including at least two drying cylinders and at least one cooling cylinder, each said cooling cylinder disposed downstream from each said drying cylinder, relative to the running direction of the paper web;

a plurality of non-thermally compensated upper carrier rolls, each said upper carrier roll disposed adjacent to a pair of said upper cylinders;

an upper felt alternately carried by each of said upper cylinders and each of said upper carrier rolls;

a lower tier including a plurality of rotatable lower cylinders for carrying the paper web, each of said lower cylinders having an inner chamber, said plurality of lower cylinders including at least two drying cylinders and at least one cooling cylinder, each said cooling cylinder disposed downstream from each said two drying cylinder, relative to the running direction of the paper web;

a plurality of non-thermally compensated lower carrier rolls, each said lower carrier roll disposed adjacent to a pair of said lower cylinders;

a lower felt alternately carried by each of said lower cylinders and each of said lower carrier rolls;

a steam generating device fluidly connected with said inner chamber of each said drying cylinder of said upper tier and said lower tier; and a cooling fluid generating device fluidly connected with said inner chamber of each said cooling cylinder of said upper tier and said lower tier; said cooling fluid generating device transporting a cooling fluid through said inner chamber of each said cooling cylinder of said upper tier and said lower tier, said cooling fluid having an operating temperature which is below an operating temperature of the paper web at each respective said cooling cylinder.

10. The dryer group of claim 9, wherein said cooling fluid generating device defines a means for providing independent flows of said cooling fluid to each said cooling cylinder of said upper tier and said lower tier.

11. The dryer group of claim 9, wherein each said cooling cylinder of said upper tier and said lower tier includes an outer surface, and wherein said cooling fluid generating device defines a means for generating water condensation on said outer surface of at least one of said cooling cylinders.

12. The dryer group of claim 9, wherein said cooling fluid comprises cooling water which is provided to each said cooling cylinder at a temperature of between approximately 1° F. and 400° F.

13. The dryer group of claim 12, wherein said cooling fluid comprises cooling water which is provided to each said cooling cylinder at a temperature of between approximately 1° F. and 300° F.

14. The dryer group of claim 13, wherein said cooling fluid comprises cooling water which is provided to each said cooling cylinder at a temperature of between approximately 1° F. and 211° F.

15. The dryer group of claim 9, wherein said cooling fluid comprises a liquid.

16. The dryer group of claim 1, wherein each of said first circumferences of said upper cylinders and said third circumferences of said lower cylinders are substantially equal, and each of said second circumferences of said upper carrier rolls and said fourth circumferences of said lower carrier rolls are substantially equal.

* * * * *